US005996887A

United States Patent [19]

Cai et al.

[11] Patent Number: 5,996,887

[45] Date of Patent: Dec. 7, 1999

[54] CUP WITH SEPARABLE COUPON

[75] Inventors: Liming Cai, West Chester; Joel B. Corder, Douglassville; Chris T. Bruch, Downingtown, all of Pa.

[73] Assignee: Dopaco, Inc., Exton, Pa.

[21] Appl. No.: 09/172,869

[22] Filed: Oct. 15, 1998

[51] Int. Cl.[6] ..... B65D 3/28

[52] U.S. Cl. ..... 229/400; 206/831; 229/116.1

[58] Field of Search ..... 229/116.1, 116.3, 229/400; 206/459.5, 831; 40/306, 312, 324

[56] References Cited

U.S. PATENT DOCUMENTS

| | | | |
|---|---|---|---|
| 2,053,726 | 9/1936 | Marshall . | |
| 2,134,971 | 11/1938 | Guyer | 229/116.3 |
| 2,745,586 | 5/1956 | Thoma . | |
| 3,455,497 | 7/1969 | Gillam | 206/831 |
| 3,739,975 | 6/1973 | Davidow . | |
| 3,827,620 | 8/1974 | Ludder . | |
| 3,850,361 | 11/1974 | Day et al. . | |
| 4,108,350 | 8/1978 | Forbes, Jr. . | |
| 4,171,085 | 10/1979 | Doty . | |
| 4,234,121 | 11/1980 | Sasaki . | |
| 4,318,235 | 3/1982 | Augeri . | |
| 4,453,664 | 6/1984 | Oliff | 206/459.5 |
| 4,518,639 | 5/1985 | Phillips . | |
| 4,706,873 | 11/1987 | Schulz . | |
| 4,834,240 | 5/1989 | Dagostine | 206/459.5 |
| 5,007,578 | 4/1991 | Simone . | |
| 5,025,981 | 6/1991 | Schellenberg . | |
| 5,076,433 | 12/1991 | Howes . | |
| 5,697,549 | 12/1997 | Yocum . | |

*Primary Examiner*—Gary E. Elkins
*Attorney, Agent, or Firm*—Dennison, Meserole, Scheiner & Schultz

[57] ABSTRACT

A beverage cup with an integral coupon panel extending from an outer seam edge of the cup and overlying the outer face of the cup wall. The coupon panel includes a central vertically downward strippable coupon integral with vertical side retaining strips along severance lines with the retaining strips bonded to the cup wall and the coupon free of the cup wall and secured solely by the side retaining strips.

17 Claims, 3 Drawing Sheets

58
52
54
18
16
56

50
58
52
54
60
18
56

42
40
42
46
44
16
18
48

36
34
34
38
36

CUP WITH SEPARABLE COUPON

BACKGROUND OF THE INVENTION

The invention broadly relates to coupons for prizes and the like which are associated with containers for comestibles, and more particularly drinking or beverage cups.

While such coupons are generally known, most are less than completely satisfactory for any of a variety of reasons.

For example, one major problem encountered is that the removal or exposure of the coupon requires at least a partial weakening or destruction of the cup itself by an actual removal of a section of the cup wall or, if the coupon is adhesively secured, by a tearing of the adhesive bond which itself tends to peel away and weaken a portion of the cup wall.

Other problems arise in the actual forming of the coupon. For example, if the coupon is formed as a part of the cup blank, this frequently gives rise to excess waste material in the cutting layout to accommodate rather irregularly shaped extensions which are used to define the coupon. Similarly, in those instances wherein the coupon is formed separately from the cup or container and subsequently secured thereto or inserted therein, the expense involved in separately forming the coupon, printing the coupon and applying or inserting the coupon would result in a coupon cup which is not economically practical, particularly when considering the millions of such cups which are used each year and disposed of after a single use.

SUMMARY OF THE INVENTION

The coupon cup of the invention is considered to incorporate features which distinctly advance this rather crowded art. More particularly, the coupon, formed integrally with the cup blank itself, is uniquely positioned and secured to both hide the "prize" face thereof and allow for a ready severing from the cup, either with or without the cup contents therein, without in any way disrupting or weakening the structure of the cup and without a spilling of cup contents.

The formation of the coupon as an integral extension of the cup blank is economically significant, particularly wherein, in the preferred embodiment of the invention, the coupon is so formed wherein, in the layout pattern of blanks for severing, coupons on adjacent blanks can be defined by a single cut line. In this manner, manufacture is simplified and waste is substantially reduced.

Additional manufacturing advantages are achieved by utilizing side retaining strips outward of the severable coupon itself. This is significant in that the process of attaching the coupon or coupon panel to the cup can be performed with conventional mechanical cup equipment with the application of heat to activate the adhesive being directed solely outward of the coupon itself. Thus any distortion or altering of the coupon or printing on the coupon by heat is avoided.

In achieving the objects of the invention, the coupon will extend integrally from the exterior edge of the vertical cup seam into overlying relation to the exterior surface of the cup wall, either directly beyond the seam or folded back over and beyond that portion defining the seam. In either case, the coupon is formed between a pair of laterally spaced side seams to which the coupon is joined by vertical severance lines or lines of perforation. The side seams are themselves bonded to the cup wall while the coupon is neither directly secured to the underlying cup wall nor subjected to any manufacturing procedures which would tend to distort or otherwise disrupt the coupon.

Removal of the coupon merely requires a downward stripping of the coupon from the side seams without disrupting the adhesively secured side seams and without causing any disruption or removal of any portion of the cup itself. In this manner, the entire integrity of the cup is retained. It will also be recognized that in the formation of the coupon whereby removal thereof requires only a downward stripping of the coupon from the cup toward the supporting table, there will be no tendency to spill the contents of a full cup, or cause any disruptive squeezing or side movement of the cup as would result were it necessary to laterally or upwardly strip the coupon.

In a preferred form of the coupon cup, the coupon is so formed as to be of a height no greater than one-half the height of the cup whereby the coupons of adjacent blanks in a blank layout can be formed with a single knife cut.

Other features, advantages, and objects of the invention will become apparent from the more detailed description following hereinafter.

DESCRIPTION OF PREFERRED EMBODIMENTS

Figure 1:
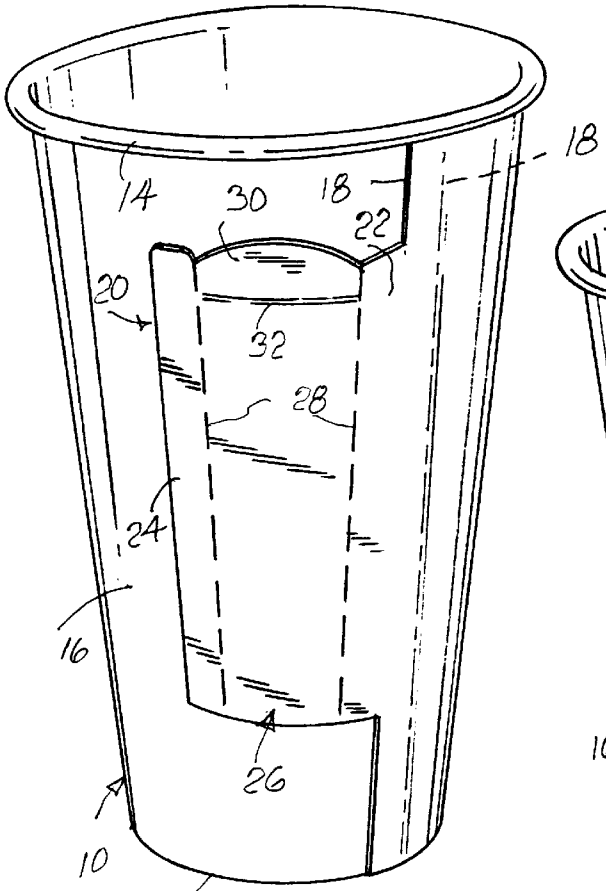
FIG. 1 is a perspective view of a cup with integral coupon in accord with the present invention and extending exteriorly beyond the formed seam.

Referring now more specifically to the drawings, FIG. 1 illustrates a beverage cup or the like 10, preferably of an inverted slightly conical configuration from a truncated flat bottom 12 to a rolled upper rim 14. The cup wall 16 comprises a sheet of appropriate material such as coated paperboard or the like with the opposed edges 18 overlapped and adhesively or otherwise bonded to each other to form a sealed seam. The structure thus far described is that of a conventional beverage or drinking cup, or for that matter a cup container for french fries or the like.

The improvement of the present invention involves the provision of a coupon panel 20 integral with the cup wall 16 vertically along the outer seam edge 18 for a substantial portion of the height thereof. The coupon panel extends beyond the outer seam edge 18 in overlying relation to the cup or container wall 16 and is adhesively or otherwise bonded threreto along two substantially full height retaining strips 22 and 24. The inner retaining strip 22 defines that edge of the coupon 20 which is integral with the seam edge. The retaining strip 24 comprises the vertical outer edge portion of the coupon panel. The coupon 26 itself is of substantially full height with the retaining strips 22 and 24 and is integral therewith along vertical severance lines 28, preferably defined by a series of perforations.

The retaining strips 22 and 24, while not limited thereto, are preferably of a minimum width required to obtain an effective and permanent adherence of the strips, and hence the vertical edges of the coupon panel 20, to the cup wall 16 while retaining the coupon 26 flat against the cup wall without an actual adherence thereto. This is essential in avoiding any tendency for a heat or otherwise sealing of the coupon panel to disrupt any indicia or the like appearing on the normally hidden inner face of the coupon 26.

Figure 2:
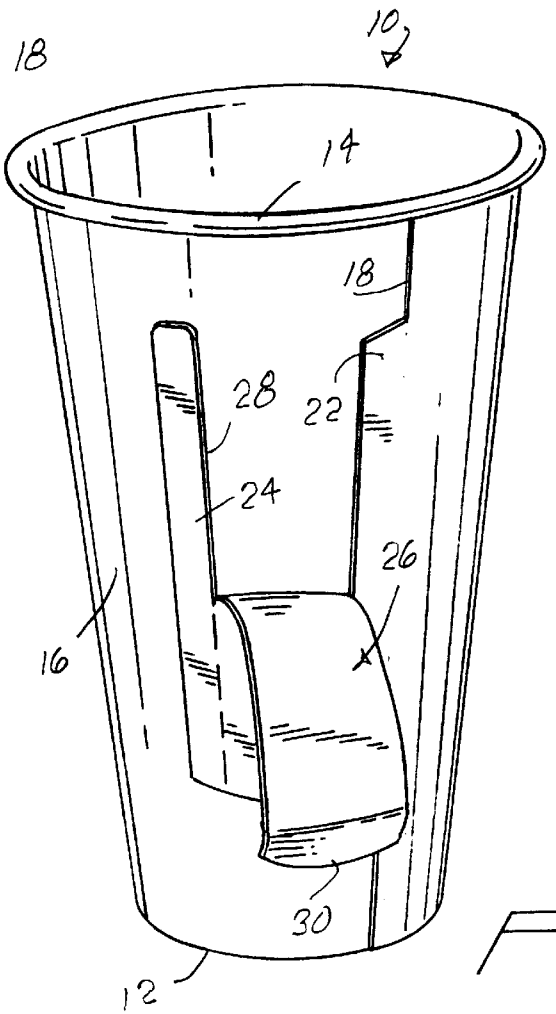
FIG. 2 is a similar perspective view illustrating the manner in which the coupon is severed from the cup.

It is also to be appreciated that release along the perforated or otherwise provided severance lines 28, noting FIG. 2 in conjunction with FIG. 1, allows for a stripping away of the coupon 26 and an exposure of the "prize" inner face thereof without a tearing or otherwise cutting or disrupting of the cup wall 16 as would be required were an actual portion of the cup wall to be removed, or were it necessary to attempt a release of the adhesively secured mounting portions of the coupon panel. Such a removal of a directly adhered strip would in itself tear or otherwise weaken the wall of the cup. This is avoided in the present invention. With continued reference to FIGS. 1 and 2, it is contemplated that removal of the coupon 26 be facilitated by defining the upper portion of the coupon 26 as a gripping tab 30 partially severed from the side retaining strips 22 and 24, or otherwise easily manually accessed. A fold line 32 can be provided between the tab 30 and the main portion of the coupon 26 immediately therebelow to facilitate a manual gripping of the coupon 26 and a downward stripping or separation thereof from the secured retaining strips 22 and 24 as best seen in FIG. 2.

It is considered of particular significance that the coupon 26 is so positioned as to peel downwardly from the cup wall 16. As such, any force developed on the cup 10 as the coupon is peeled therefrom is downward against the table or other similar support surface for the cup. Thus, the severing force, as might otherwise distort the cup were the coupon stripped sideways or upward from the cup, is effectively avoided. This is a particularly desirable feature in those instances wherein the coupon is to be removed from a cup filled with a beverage wherein any squeezing of the cup, as would most likely occur were the coupon laterally or upwardly stripped, would cause undesirable spillage.

Figure 3:
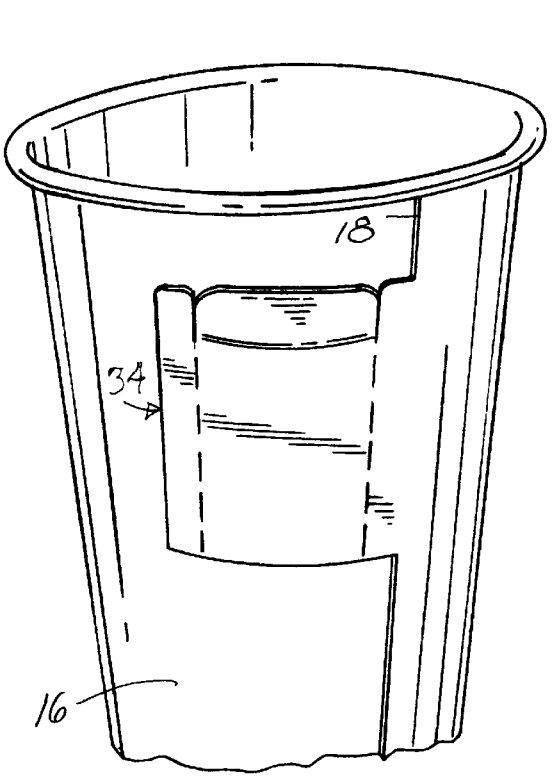
FIG. 3 is a perspective view of a cup, with the bottom broken away, illustrating an integral coupon of a height less than one-half the height of the cup and vertical seam thereon.
Figures 4, 5, 6, 7:
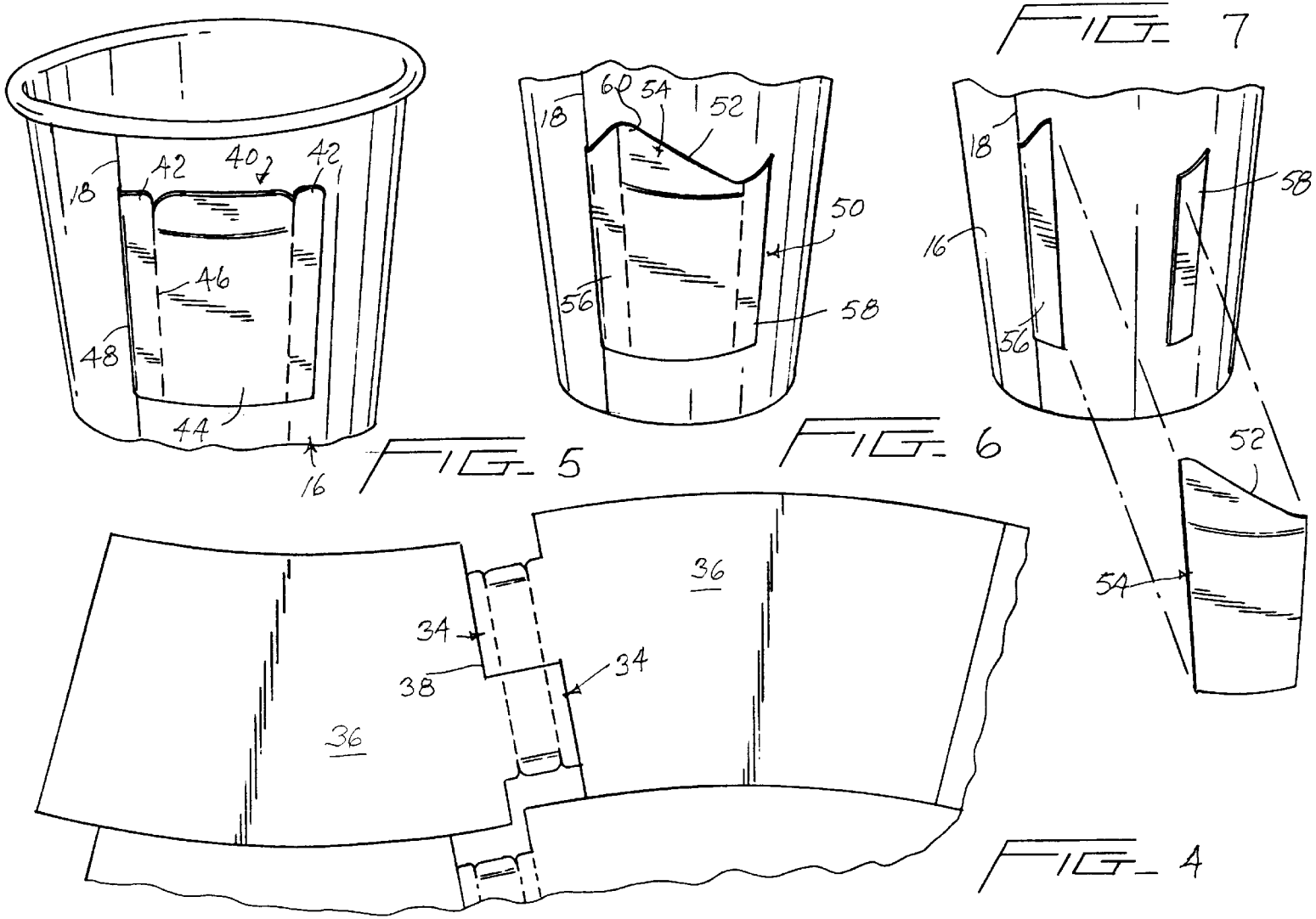
FIG. 4 is a plan view of a blank layout illustrating the manner in which a single knife cut can be utilized to form coupons, as in FIG. 3, within adjacent blanks.
FIG. 5 is a perspective view of the upper portion of a cup wherein the coupon, integral with the cup wall at the exterior vertical seam, is reversely folded over the seam to overlie the cup wall to the opposite side of the seam from the coupon of FIG. 3.
FIG. 6 illustrates a reversely folded coupon of a different configuration.
FIG. 7 is a perspective detail illustrating the coupon of FIG. 6 removed from the adhesively secured retaining strips.

In FIGS. 3 and 4, the coupon panel 34 therein differs from the coupon panel 20 only in that the height of the coupon panel 34 is no greater, and preferably less, than one-half the height of the outer seam edge 18. The significance of this will be appreciated from FIG. 4 wherein a layout pattern for the cutting of multiple blanks has been illustrated with the coupon panels 34 of adjacent wall blanks 36, one inverted relative to the other, can be defined by a single knife cut 38. In this manner, formation of the coupon panels is facilitated and blank scrap is minimized. As will also be appreciated from FIG. 4, the coupon panels are inwardly offset from the upper and lower edges of the wall panel blanks 36 as to allow for an appropriate rolling or flanging of these edges in defining the structure of the cup itself.

FIG. 5 illustrates a coupon panel 40 which varies from the coupon panel 34 only in that the coupon panel 40 is rearwardly folded about the outer seam edge 18 to overlie the seam itself and the wall to the opposite side of the outer seam edge 18 from the coupon panel 34 of FIG. 3. In this instance, the adhesively bonded faces of the side retaining strips 42 will be those faces now directly engaging the cup wall. As in the previously described embodiments, the coupon 44 itself, while closely overlying the cup wall, will not be directly secured thereto, but rather only secured through opposed severance lines 46 to the side retaining strips 42. It will also be appreciated that the blank for the coupon cup of FIG. 5 will be substantially the same as that illustrated in the blank layout of FIG. 4, other than for the addition, preferably, of a fold line 48 along the outer seam edge 18 between the inner retaining strip 42 and the cup wall to facilitate an appropriate rearward folding of the coupon panel 40.

Figure 8:
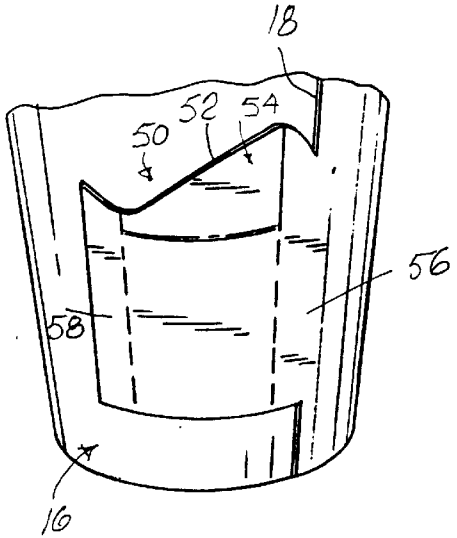
FIG. 8 is a perspective detail of a cup coupon similar to the coupon of FIG. 6 but extending beyond the seam.
Figure 9:
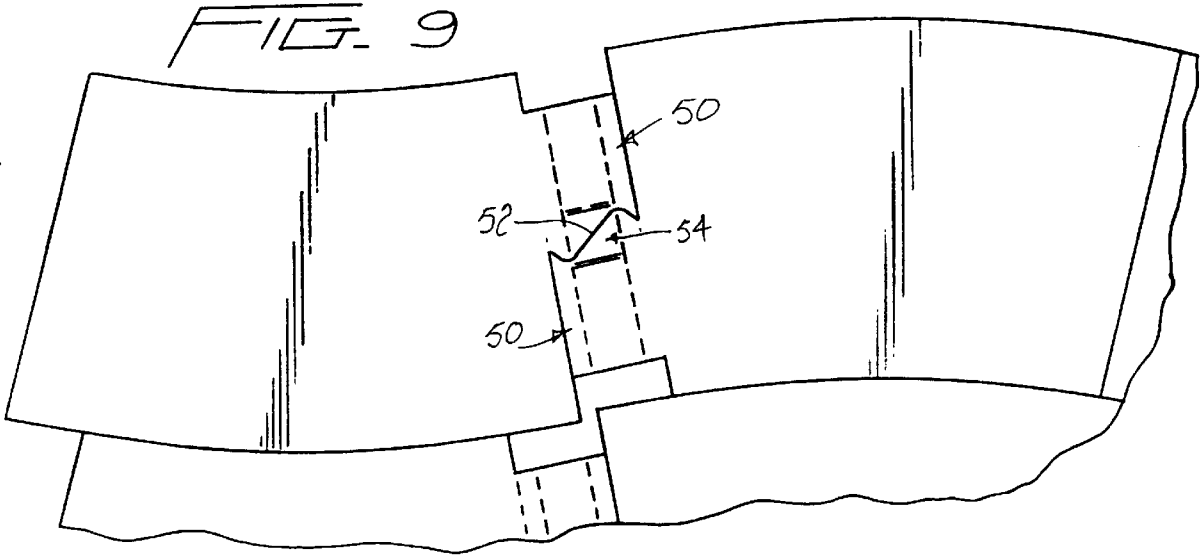
FIG. 9 is a partial plan view of a blank layout wherein coupons configured as in FIGS. 6 and 8 are defined in adjacent blanks by a single knife cut.

FIGS. 6, 7 and 8 illustrate a further variation wherein the coupon panel 50 is either reversely folded over the seam as in FIG. 6, or, as in FIG. 8, extends outwardly beyond the outer seam edge 18 in intimate overlying engagement with the outer surface of the cup wall 16. The coupon panel 50 differs in that the upper edge thereof is of a wave-like configuration with that portion 52 which defines the upper edge of the tab 54 being inclined downward from the innermost retaining strip 56 to the outer retaining strip 58. The upper edges of the retaining strips 56 and 58 are respectively downwardly curved and upwardly curved at equal curvatures to allow, in the blank layout of FIG. 9, a single knife cut therebetween, and the resultant manufacturing and waste reduction features desired. This particular configuration of the upper edge, and more particularly the tab 54 is desirable in providing for an upper corner tab portion 60 which can be easily manually grasped for the desired downward stripping of the central coupon from the secured side retaining strips 56 and 58, as suggested in FIG. 7.

Figure 10:
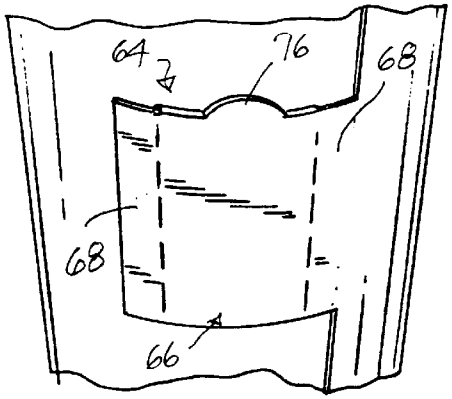
FIG. 10 is a perspective view of another form of coupon with a hidden extension panel.
Figure 11:
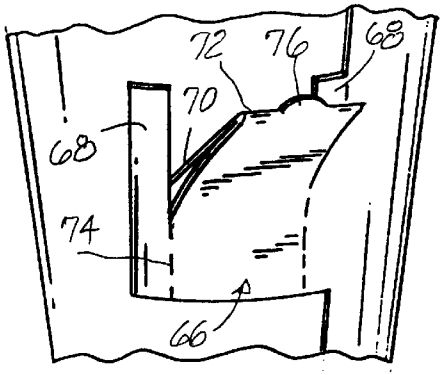
FIG. 11 is a similar perspective view with the coupon partially peeled downward away from the cup.
Figure 12:
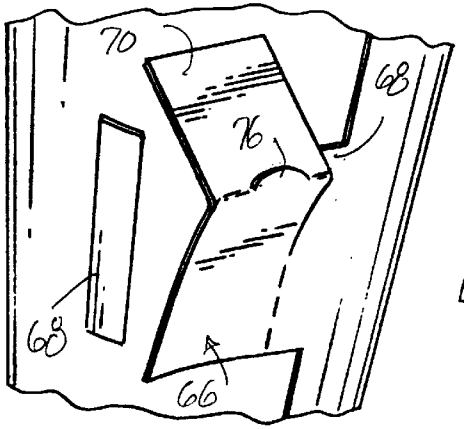
FIG. 12 is a perspective view illustrating the coupon almost completely severed from the cup and with the extension or extension panel upwardly exposed.

A further form of coupon panel 64 is illustrated in FIGS. 10, 11 and 12. This coupon panel 64, while incorporating the unique features of the previously described panels, differs therefrom in that the coupon 66, between the adhesively secured side retaining strips 68, has an integral upwardly directed extension or extension panel 70 above the coupon 66 and inwardly folded relative thereto along an upper fold line 72 defining the exposed upper edge of the coupon. The extension 70, in the mounted coupon panel 64, lies behind the main coupon 66 in underlying parallel relation thereto and freely between the adhesively mounted side retaining strips 68 which in turn are integral with the opposed side edges of the coupon 66 with severance or perforation lines 74 defined therebetween. The upper exposed edge of the mounted coupon 66, defined by the fold line 72, includes a central upwardly projecting gripping tab 76 which is integral and coplanar with the face panel of the coupon outward of the extension panel 70. The tab 76 is, preferably, cut from the inner edge portion of the extension panel 70. As will be appreciated from FIGS. 11 and 12, this tab 76 can be readily grasped within the fingers and the coupon 66 stripped outwardly and downwardly from the retaining strips 68, thereby exposing both the extension panel 70 and the entire inner face of the coupon 66.

This extension of the coupon will effectively increase the total area of the coupon for additional indicia or information which will be effectively hidden until the coupon is removed. As with the prior embodiments, removal of the coupon 66 will in no way affect the integrity of the cup itself.

As will be appreciated from the foregoing, the coupon cup of the invention is unique in several aspects, including the manner in which the coupon is formed and positioned and the manner in which the coupon is positioned for removal without disruption of the cup itself. In this regard, the coupon is formed as an integral extension of the blank and is secured to the cup solely through side retaining strips bonded to the outer face of the cup wall with the coupon itself freely overlying the cup wall and downwardly stripped therefrom along lines of perforation between the opposed edges of the coupon and the retaining strips which remain with the cup wall and are not destructively separated therefrom. As noted, the ability to downwardly strip the coupon is significant in that no squeezing or otherwise distortion of the cup occurs. This is particularly important when the coupon is to be removed from a full cup. Basically, one need merely place one hand on top of the cup and downwardly pull the coupon from the cup with the other hand. The coupon may either extend beyond the outer seam edge or may be reversely folded over the seam, and may, as desired include an additional inwardly folded extension panel for an increased indicia area. Such an increase in indicia area can also, as desired, allow for a reduction in the height of the mounted coupon, particularly should it be desirable to provide for a nested relationship between adjacent blanks in a cutting layout.

The securing of the coupon panels along substantially the full height of the opposed vertical edges of the coupon is significant in retaining the coupon flat against the outer face of the cup wall without actually bonding or otherwise adhering the coupon directly to the face of the cup wall. Further, the use of bonded strips laterally outward to the opposite sides of the coupon also allows for heat activation of these integral retaining strips without subjecting the printed face of the coupon to such heat as may distort or alter the printed contents. It should be appreciated that the provision of the inner retaining strip which spaces the coupon from the outer seam edge performs an additional significant function in protecting the coupon during the manufacturing process. More specifically, it is conventional to apply the cup coating, generally referred to as a "poly" coat using high temperature hot air. The slight spacing between the cup wall edge and the coupon provided by the inner retaining strip assures that any minor leakage of the coating beyond the wall edge will not extend to and inadvertently disrupt the coupon itself or coupon indicia.

While several embodiments have been illustrated and described, it is not intended that the invention be limited to the specific embodiments. Rather, all embodiments as fall within the following claims are to be considered to be within the scope of the invention.

We claim:

1. A cup for comestibles, said cup comprising a vertical wall with overlapping side edges bonded together to define a vertical seam, a coupon panel integral with said wall along one of said side edges and extending therefrom into overlapped engagement with a portion of said wall beyond said seam, said coupon panel including spaced opposed side retaining strips, said coupon panel being bonded to said walls solely along said side retaining strips, said coupon panel including laterally spaced severance lines formed therein immediately adjacent and defining the inner extents of said side retaining strips, said coupon panel between said severance lines defining a coupon, said coupon freely overlying said wall and being separable from said coupon panel along said severance lines independently of said retaining strips bonded to said wall.

2. The cup of claim 1 wherein said retaining strips comprise an inner retaining strip vertically along said seam, and an outer retaining strip remote therefrom and defining an outer edge of said coupon panel.

3. The cup of claim 2 wherein said coupon panel is of a predetermined vertical height, said severance lines extending vertically and coextensive with said coupon panel for a complete vertical stripping of said coupon from said coupon panel.

4. The cup of claim 3 wherein said coupon includes upper and lower free ends with a grasping tab defined at said upper end.

5. The cup of claim 4 including a transverse fold line defined between said tab and a portion of the coupon adjacent thereto for a selective outward folding of the tab relative to the cup wall.

6. The cup of claim 4 wherein said cup is of a predetermined height, and said coupon panel is of a height no greater than one-half the height of said cup.

7. The cup of claim 4 including an extension panel integral with and extending vertically from said coupon, said extension panel being folded to freely underlie said coupon between said retaining strips for removal from said coupon panel upon a severing of said coupon from said retaining strips.

8. The cup of claim 7 wherein said extension panel extends from said upper end of said coupon.

9. The cup of claim 4 wherein said retaining strips are of substantially equal height with said coupon.

10. The cup of claim 3 wherein said coupon panel is reversely folded into overlying relation with said seam.

11. The cup of claim 1 including an extension panel integral with and extending vertically from said coupon, said extension panel being folded to freely underlie said coupon between said retaining strips for removal from said coupon panel upon a severing of said coupon from said retaining strips.

12. A beverage cup with an integral coupon selectively separable therefrom, said cup comprising a wall with overlapping side edges bonded together to define a substantially vertical seam, a coupon panel integral with said wall along one of said side edges and extending therefrom into overlapped engagement with a portion of said wall beyond said seam, said coupon panel including opposed vertical edge portions directly secured to said cup wall, said coupon being defined between said coupon panel edge portions, and vertical severance lines defining opposed edges of said coupon at said edge portions for a severing of said coupon from said cup, said coupon freely overlying said cup wall between said severance lines for unrestricted severance from said cup along said severance lines.

13. The cup of claim 12 wherein said edge portions of said coupon panel comprise a retaining strip defined along said seam and laterally between said seam and said coupon, and a retaining strip remote from said seam.

14. The cup of claim 13 wherein said coupon panel is, at the adjoining wall seam edge, folded backward to overlie said seam.

15. The cup of claim 12 wherein said coupon panel is, at the adjoining wall seam edge, folded backward to overlie said seam.

16. The cup of claim 13 wherein said coupon includes upper and lower free ends with a grasping tab defined at said upper end.

17. The cup of claim 16 wherein said tab includes a vertically extending portion extending above said retaining strips.

* * * * *